US012372244B2

(12) United States Patent
Berg et al.

(10) Patent No.: US 12,372,244 B2
(45) Date of Patent: Jul. 29, 2025

(54) FIREPLACE WITH CONTROLLABLE AND IMAGE-BEARING REAR WALL

(71) Applicant: HNI Technologies Inc., Muscatine, IA (US)

(72) Inventors: Richard D. Berg, Lakeville, MN (US); Gary L. Butler, Silver Lake, MN (US)

(73) Assignee: HNI Technologies Inc., Muscatine, IA (US)

( * ) Notice: Subject to any disclaimer, the term of this patent is extended or adjusted under 35 U.S.C. 154(b) by 62 days.

(21) Appl. No.: 18/239,578

(22) Filed: Aug. 29, 2023

(65) Prior Publication Data

US 2023/0408099 A1 Dec. 21, 2023

Related U.S. Application Data

(62) Division of application No. 16/809,646, filed on Mar. 5, 2020, now Pat. No. 11,781,755.

(60) Provisional application No. 62/814,690, filed on Mar. 6, 2019.

(51) Int. Cl.

| | |
|---|---|
| ***F24C 3/00*** | (2006.01) |
| ***F24C 3/08*** | (2006.01) |
| ***F24C 15/06*** | (2006.01) |

(52) U.S. Cl.

CPC ..... *F24C 3/002* (2013.01); *F24C 3/082* (2013.01); *F24C 15/06* (2013.01)

(58) Field of Classification Search

CPC ..... F24C 3/002; F24C 3/082; F24C 15/06; F24C 3/006

See application file for complete search history.

(56) References Cited

U.S. PATENT DOCUMENTS

| | | | |
|---|---|---|---|
| 4,603,682 | A | 8/1986 | Maziasz |
| 5,469,839 | A | 11/1995 | Kasulis et al. |
| 6,227,192 | B1 | 5/2001 | Schake |
| 6,919,884 | B2 | 7/2005 | Mix et al. |
| 7,258,116 | B2 | 8/2007 | Searcy |
| 11,781,755 | B2 | 10/2023 | Berg et al. |
| 2006/0242870 | A1 | 11/2006 | Atemboski et al. |
| 2008/0050540 | A1 | 2/2008 | Christofer et al. |
| 2008/0168980 | A1 | 7/2008 | Lyons et al. |
| 2009/0151711 | A1 | 6/2009 | Wells et al. |
| 2010/0162600 | A1 | 7/2010 | Betz et al. |
| 2010/0170496 | A1 | 7/2010 | Berg et al. |
| 2011/0283528 | A1 | 11/2011 | Spinner |
| 2012/0192854 | A1 | 8/2012 | Binzer |
| 2015/0255519 | A1 | 9/2015 | Lee et al. |
| 2017/0269396 | A1 | 9/2017 | Northrup et al. |
| 2020/0284437 | A1 | 9/2020 | Berg et al. |

*Primary Examiner* — Alfred Basichas

(74) *Attorney, Agent, or Firm* — Faegre Drinker Biddle & Reath LLP

(57) ABSTRACT

A fireplace and method of manufacturing a fireplace. Embodiments of the fireplace comprise a combustion chamber, a front opening allowing viewing within the combustion chamber, and a back wall opposite the front opening. The back wall can be controllably switched between an opaque state and a transparent state. A combustion region between the front opening and the back wall is adapted to provide a flame. A controller coupled to the back wall enables a user to switch the back wall between the opaque and transparent states. In embodiments the back wall comprises a glass panel and switchable film on the glass panel. The controller is coupled to the switchable film.

15 Claims, 13 Drawing Sheets

FIREPLACE WITH CONTROLLABLE AND IMAGE-BEARING REAR WALL

CROSS-REFERENCE TO RELATED APPLICATION

This application claims to and is a divisional application of U.S. Ser. No. 16/809,646, filed Mar. 5, 2020, which claims the benefit of U.S. Provisional Application Ser. No. 62/814,690 filed on Mar. 6, 2019 and entitled Fireplace With Controllable And Image-Bearing Rear Wall, the entire contents of which are incorporated herein by reference in their entirety and for all purposes.

FIELD OF THE INVENTION

The invention relates generally to fireplaces. Embodiments include gas burning fireplaces.

BACKGROUND

Fireplaces, including fireplaces with combustion chambers that burn gas, are generally known and disclosed, for example, in the following U.S. published patent applications and patents, all of which are incorporated herein by reference in their entirety and for all purposes.

| Application No./U.S. Pat. No. | Inventor |
|---|---|
| 7,258,116 | Searcy |
| 2008/0168980 | Lyons et al. |
| 2009/0151711 | Wells et al. |
| 2010/0170496 | Berg et al. |

There remains a continuing need for improved fireplaces. For example, there is a need for fireplaces with enhanced functionality and esthetics. Improved fireplaces that are convenient to operate would be especially desirable.

SUMMARY

Disclosed embodiments include fireplaces and methods for manufacturing fireplaces.

One example is a fireplace comprising a combustion chamber, a front opening allowing viewing within the combustion chamber, a back wall opposite the front opening, a combustion region between the front opening and the back wall adapted to provide a flame, and an opaque and non-homogeneous image on the back wall, wherein the image is visible through the front opening and combustion region when the flame is provided in the combustion region.

In some embodiments the back wall includes a glass wall, and the image includes a printed multi-color ink image on the glass wall. The printed ink image may include ceramic ink. The combustion region may include a gas burner. The image may be an image of an outdoor area beyond or in a vicinity of the fireplace. The image may include one of a cityscape and a landscape. The image may include one of a cityscape, a landscape, a brick wall, a wood wall, a tile wall, and a team logo. The image may include a heat-resistant, printed multi-color ink image on the back wall.

Another example is a method for manufacturing a fireplace of the type including a combustion chamber, a front opening allowing viewing within the combustion chamber, a back wall opposite the front opening and a combustion region between the front opening and the back wall adapted to provide a flame. The method comprises receiving an electronic file for a non-homogenous image, transferring the electronic file to a printer and causing the printer to print the image on the back wall, receiving the back wall including the printed image, and assembling the back wall including the printed image into the fireplace.

In some embodiments receiving the electronic file may include receiving the electronic file for a multi-color image. Transferring the electronic file to the printer may include causing the printer to print the image in ceramic ink on the back wall. Transferring the electronic file to the printer may include causing the printer to print the image on a glass back wall. Receiving the electronic file may include receiving the electronic file for an image including one of a cityscape, a landscape, a brick wall, a wood wall, a tile wall, and a team logo. Receiving the image file may include receiving the image file over the Internet. Transferring the electronic file to the printer may include transferring the image file over the Internet.

Another example is a fireplace comprising a combustion chamber, a front opening allowing viewing within the combustion chamber, a back wall opposite the front opening, wherein the back wall can be controllably switched between an opaque state and a transparent state, a combustion region between the front opening and the back wall adapted to provide a flame, and a controller coupled to the back wall enabling a user to switch the back wall between the opaque and transparent states.

In some embodiments the back wall comprises a glass panel and switchable film on the glass panel. The controller may be coupled to the switchable film. The opaque state may be a frosted state.

DETAILED DESCRIPTION

Figure 1:
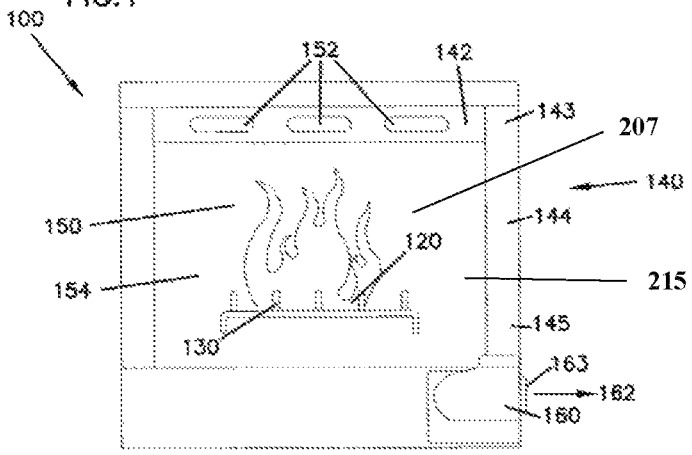
FIG. 1 is a schematic elevation view of a fireplace including a rear wall in accordance with embodiments.
Figure 2A:
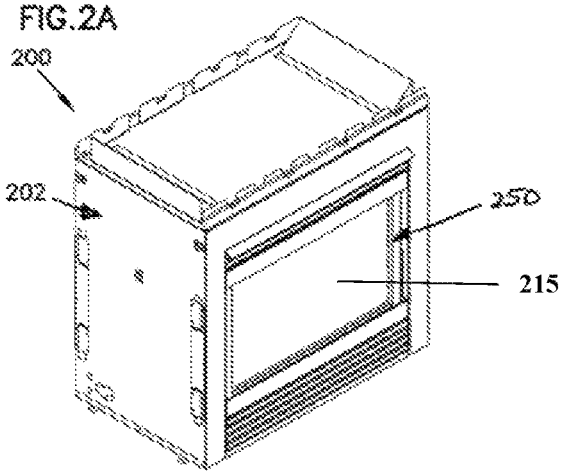
FIGS. 2A and 2B are isometric views of an example embodiment of a fireplace in accordance with the present disclosure.
Figure 2B:
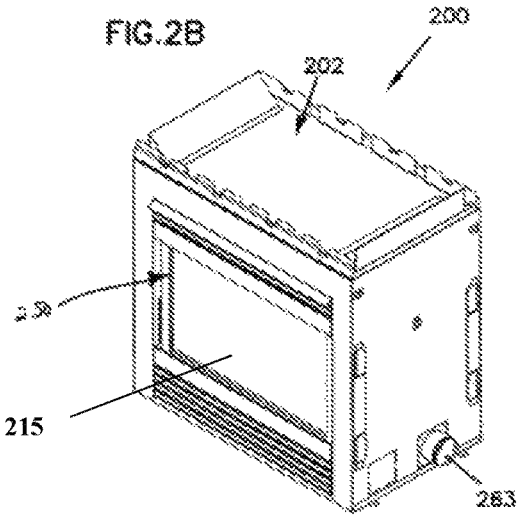
Figure 3A:
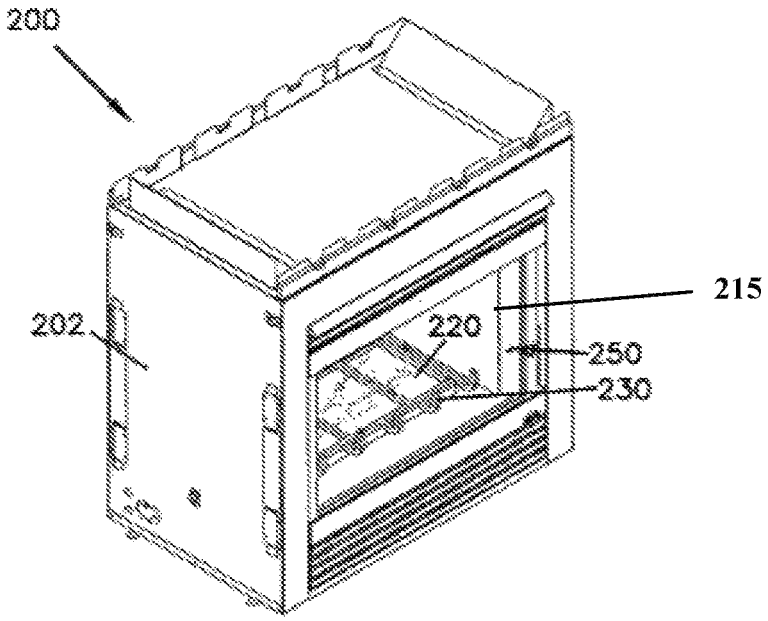
FIGS. 3A and 3B are isometric views of the fireplace embodiments shown in FIGS. 2A and 2B, showing burner and grate assemblies in the combustion chamber.
Figure 3B:
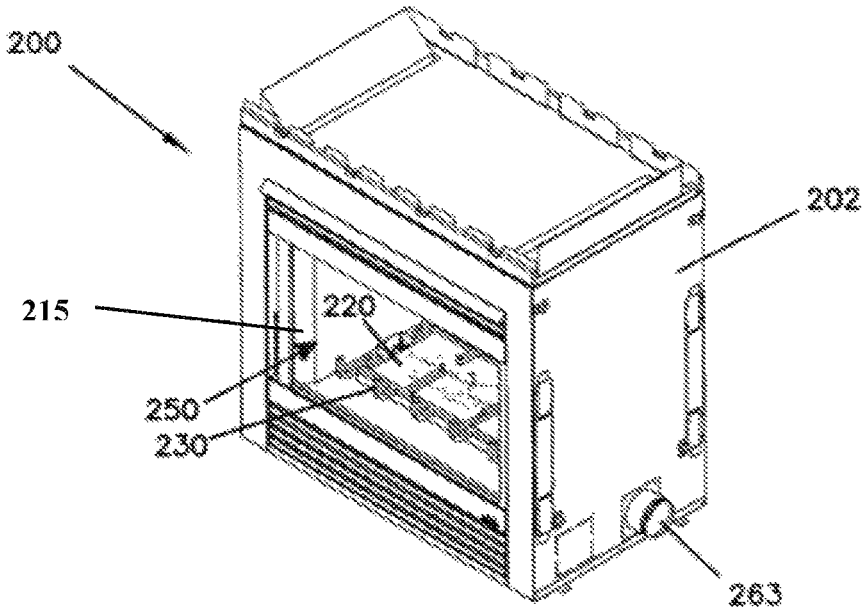

FIG. 1 is an example of a fireplace 100 (with the front section cut-away for illustrative purposes) that includes a controllable and image-bearing back or rear wall 207 in accordance with embodiments of the invention. As shown, the fireplace 100 includes a firebox (or combustion chamber enclosure) 150 having a combustion region including a burner 120 and a grate 130. A combustible gas or fuel, for example natural gas or liquid propane gas, is delivered to the burner 120, which is located in a combustion chamber 154 that is defined by firebox 150, where it is then combusted to provide a flame. As described in greater detail below, in embodiments, rear wall 207 can include printed images, such as cityscapes and landscapes, that are visible to a user through a front side access opening 215 and the combustion region. In embodiments, the rear wall 207 can be controllably switched between transparent and opaque states, enabling the user to control whether the combustion region can be viewed from the back side of the fireplace 100 (i.e., from the side opposite the access opening 215).

Combustion products generated by combustion of fuel at the burner 120 can be exhausted from the fireplace 100 via a venting or air guide arrangement 140. The illustrated embodiment of venting arrangement 140 includes an upper exhaust guide 142, where combustion products are removed from the firebox 150 through firebox exhaust outlets 152. The upper exhaust guide 142 and exhaust outlets 152 cooperate to form a plenum or manifold for collecting combustion products, which can be of any suitable geometric arrangement. The exhaust outlets 152 are located in the upper section of the combustion chamber in embodiments, though any location that allows exhaust gases to be drawn into the exhaust outlets is suitable. The upper exhaust guide 142 fluidly communicates with an exhaust passage 144 that runs from top to the bottom of the firebox 150. The exhaust passage 144 includes an upper end 143 and a lower end 145. The upper end 143 of the exhaust passage 144 is in fluid communication with the upper exhaust guide 142. The lower end 145 of the exhaust passage 144 is in fluid communication with a blower arrangement 160 located outside the firebox 150. The blower arrangement 160 is located below the upper exhaust guide 142, and is located below the combustion chamber 154 in embodiments. The blower arrangement 160 includes an exhaust section 162. The exhaust section 162 is located adjacent an exhaust port 163 in the fireplace 100. The exhaust port 163 is connected to a ducting arrangement (not shown). Other embodiments of fireplace 100 include other venting arrangements 140.

The blower 160 operates generally when the burner 120 in the fireplace 100 is operating, such that combustion products are taken in the firebox exhaust outlets 152 in the upper exhaust guide 142. The blower can also continue to run until a temperature sensor in the fireplace senses a pre-set temperature. This allows the blower to run for a time after the fire is extinguished. The combustion products are then moved downwardly from the upper exhaust guide 142 through the exhaust passage 144. The combustion products are then exhausted from the fireplace 100 through the exhaust port 163 and into an exterior ducting arrangement (not shown) to be exhausted to atmosphere. An advantage of the illustrated embodiment is that the fireplace 100 can be located in a house or other structure unconstrained by the need for a vertical rise to get the natural draft, driven by the buoyant forces of the heated combustion products, of the fireplace 100 venting the combustion products. While in the example embodiment shown the exhaust port 163 is located below the firebox 150, it can also be located adjacent the firebox 150. Similarly, while the example embodiment shows the exhaust port 163 passing through a sidewall of the fireplace 100, the exhaust port 163 could also be placed in other suitable locations, for example, the bottom of the fireplace 100. The fireplace 100 can be constructed and assembled from formed sheet metal parts that are connected together by sheet metal screws, rivets, spot welds, crimping or other equivalent means of connection, all of which is well-known in the art.

Referring to FIGS. 2A, 2B and 3A, 3B, shown is an example embodiment of a fireplace 200 that can be similar to fireplace 100. The fireplace 200 includes an outer shell 202 that houses the firebox 250 and other components. Insulation 291 (see FIG. 4) between the outer shell 202 and the firebox 250 keeps the surfaces of the outer shell 202 cool, and may further provide a sound dampening function to reduce noise generated within fireplace 200. The fireplace 200 also includes a burner assembly 220 in a combustion region of the firebox 250. The burner assembly 220 creates the flames from combustion of the fuel provided to the fireplace, typically LP or natural gas. A grate 230 is located adjacent to the burner assembly 220 and can hold decorative logs or rocks. The fireplace 200 includes a bottom vent port 263, which is coupled to an exhaust ducting arrangement to remove combustion products when the fireplace 200 is operating.

Figure 4:
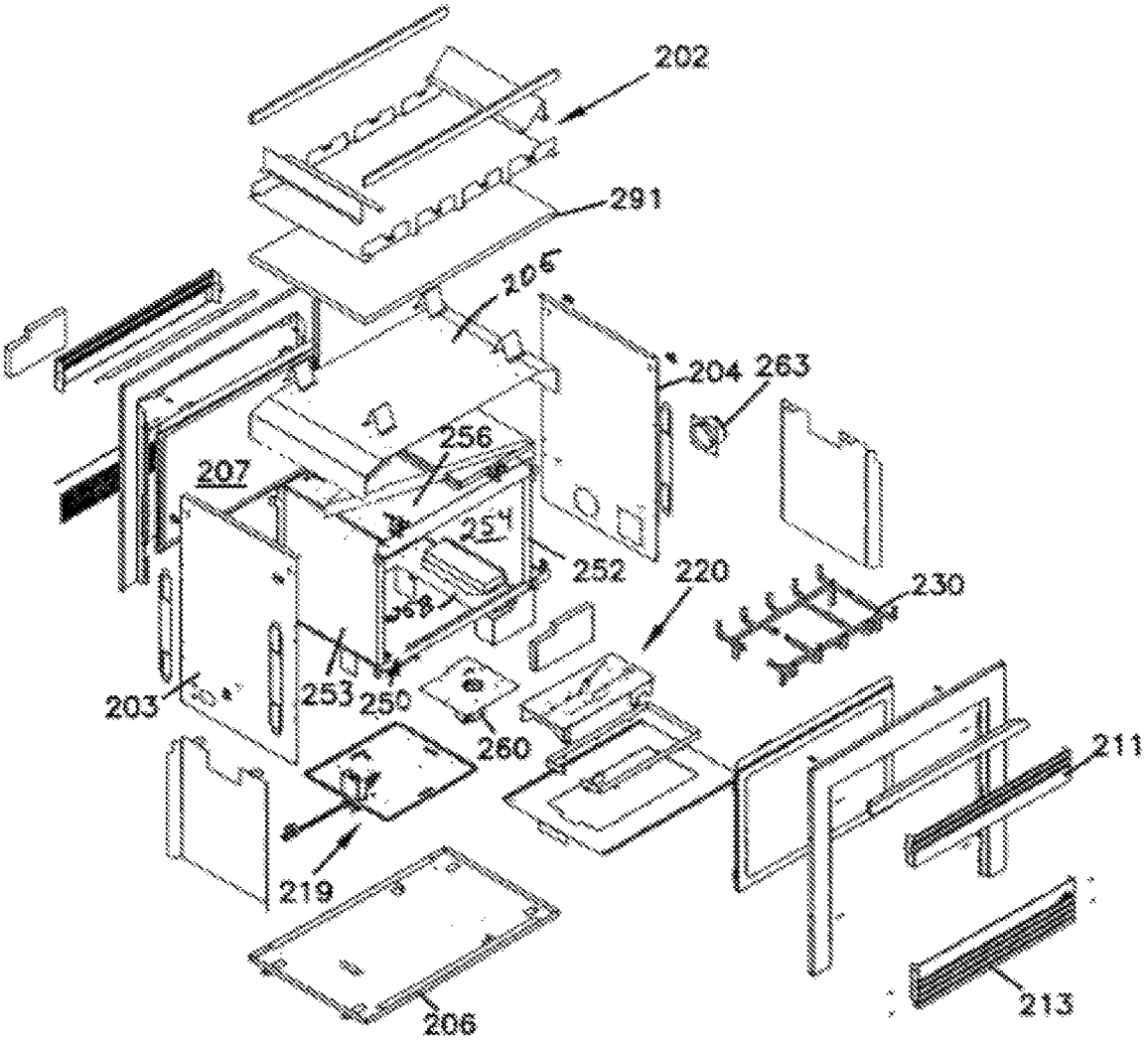
FIG. 4 is an exploded view of the fireplace shown in FIGS. 1, 2A, 2B, 3A and 3B.
Figure 5:
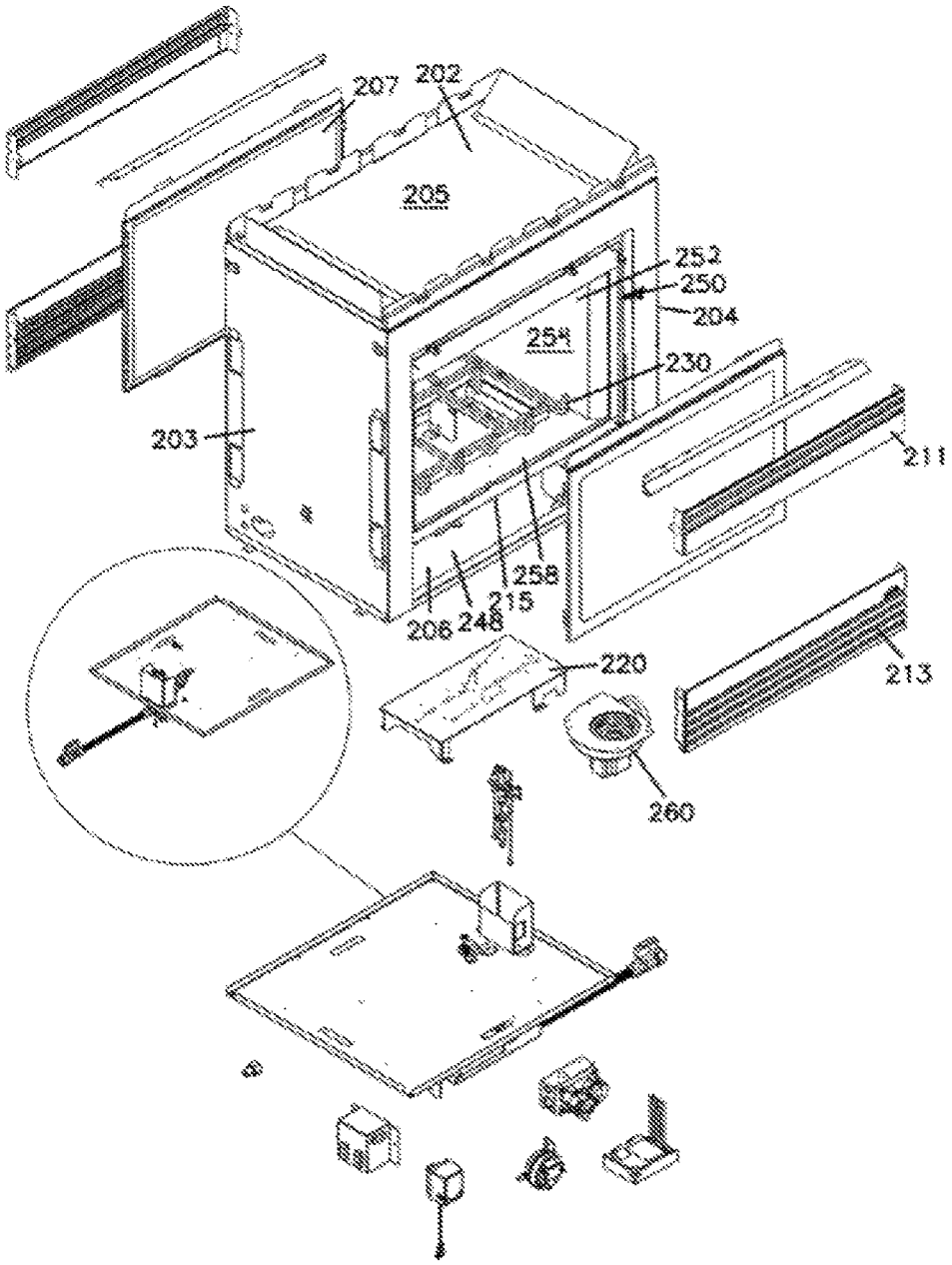
FIG. 5 is another exploded view of the fireplace shown in FIGS. 1, 2A, 2B, 3A and 3B.

Referring to FIGS. 4 and 5, the firebox 250 is comprised of opposite right 252 and left 253 side panels, opposite top 256 and bottom 258 panels. The panels 252, 253, 256, 258 define a heat or combustion chamber 254 of the firebox 250 that is accessible and viewable through the front or access opening 215 of the fireplace 200. In embodiments, a transparent glass panel or doors (e.g., that can be open and closed) can be located at or enclosed the access opening 215. The heat chamber 254 defines a combustion region that contains the gas burner 220 as well as a decorative grate 230 and the gas logs or rocks (not shown) that cover the gas burner 220. A conventional-gas supply control assembly 219 controlling the supply of gas to the burner 220 is secured to the underside of the firebox bottom panel 258. Exhaust means exhaust combustion products or fumes from the combustion chamber 254.

The outer shell 202 encloses the firebox 250 and supports the firebox 250 in the outer shell 202 to create a heat exchange volume 248 between the exterior of the firebox 250 and the interior of the outer shell 202. The outer shell 202 includes opposite left 203 and right 204 side walls, opposite top 205 and bottom 206 walls and the rear wall 207. The walls are connected together surrounding the firebox 250. Top 211 and bottom 213 louvers extend between the outer shell 202 side walls 203, 204 above and below the access opening 215 of the firebox 250. Ambient room air is drawn into the heat exchange volume 248 through the bottom vent louver 213 and the heated air is then returned into the room out through the top vent louver 211.

The illustrated embodiment of firebox 250 contains exhaust outlets in the upper part of the firebox 250. The exhaust outlets 257 fluidly couple the combustion chamber 254 to an upper exhaust plenum 255 formed between the upper panel 205 of the firebox 250 and an upper exhaust guide 270. Combustion products are pulled into the upper exhaust plenum 255 by operation of a blower 260 (see FIGS. 4 and 5) located adjacent the exhaust port 263. The upper exhaust plenum 255 is fluidly coupled to a substantially vertical exhaust passage 244 between the upper exhaust plenum 255 and the blower 260. The exhaust passage 244 allows combustion products to pass from the upper exhaust plenum 255 to the blower 260 and then out the exhaust port 263, with the combustion products traveling in a downward direction. With the blower 260 operating, combustion products are drawn from the combustion chamber 254 into the upper exhaust plenum 255, through the exhaust passage 244 and then through the blower 260 and out the exhaust port 263. Preferably, the combustion products are exhausted from the exhaust port 263 into a ducting arrangement. An advantage is that the blower 260 allows the fireplace 200 to exhaust to a ducting arrangement having an initial horizontally oriented section coupled directly to the exhaust port 263. An advantage of the disclosed embodiment is that it allows placement and operation of a fireplace that may not otherwise be possible using natural ventilation methods and apparatuses.

Figure 6A:
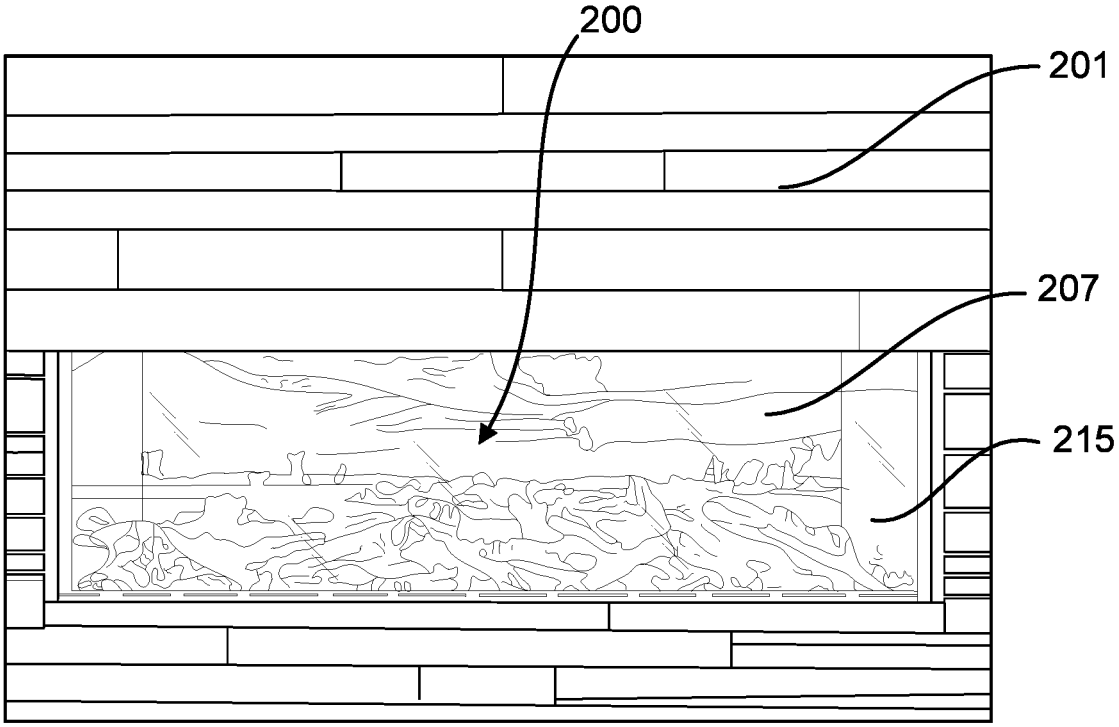
FIGS. 6A and 6B are illustrations of a fireplace with an image-bearing rear wall in accordance with embodiments.
Figure 6B:
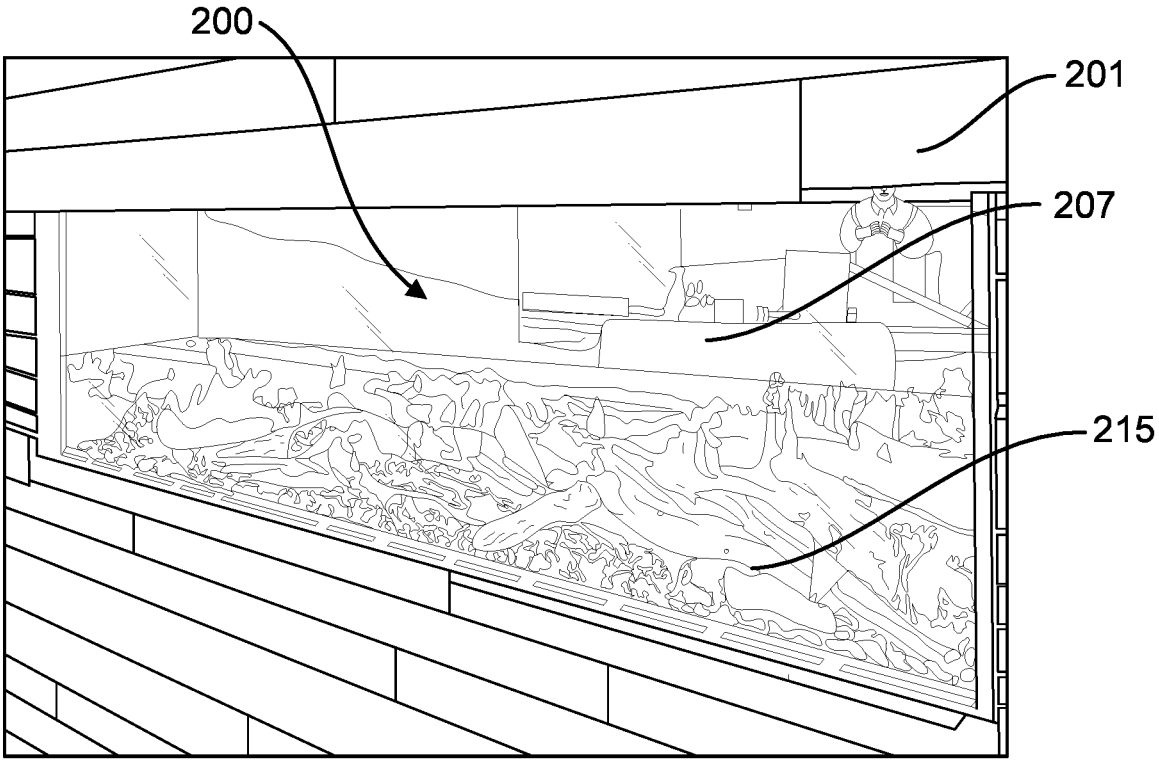
Figure 7A:
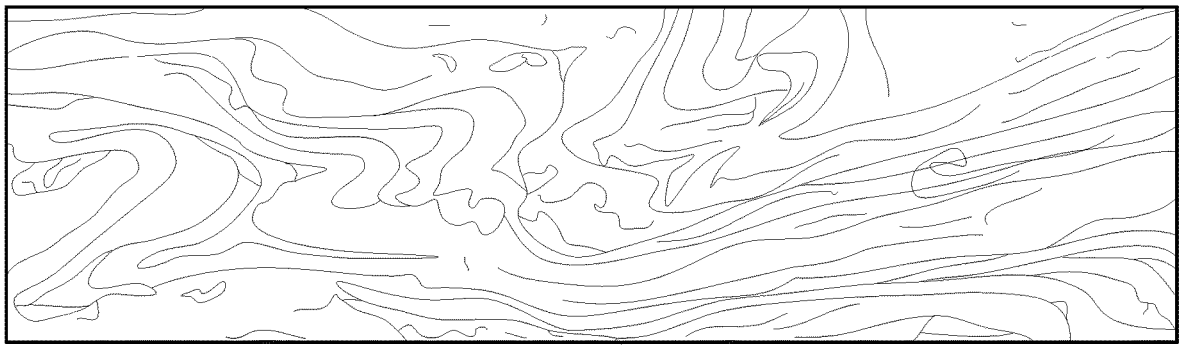
FIGS. 7A-7H are examples of images that can be incorporated into the fireplace in accordance with embodiments.
Figure 7B:
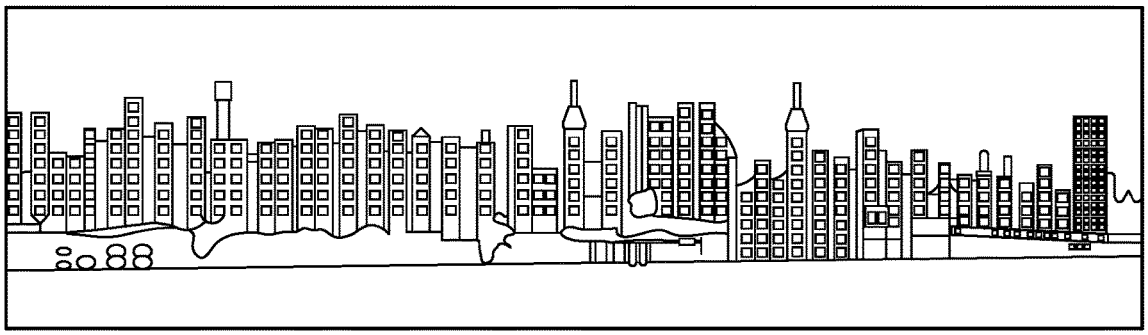
Figure 7C:
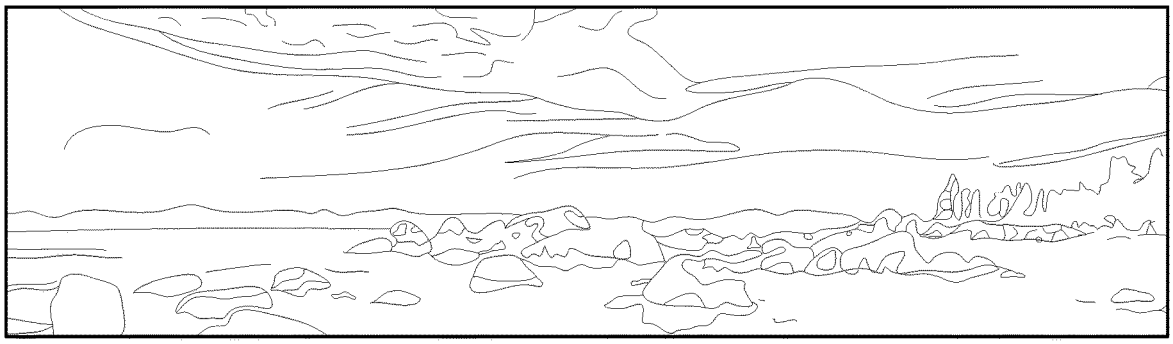
Figure 7D:
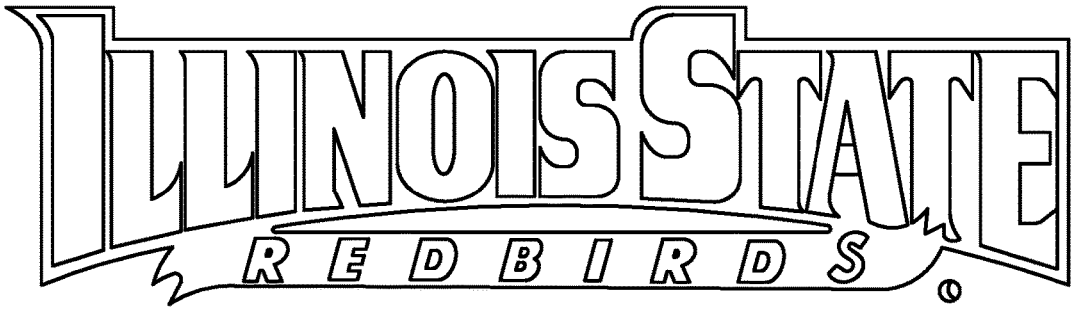
Figure 7E:
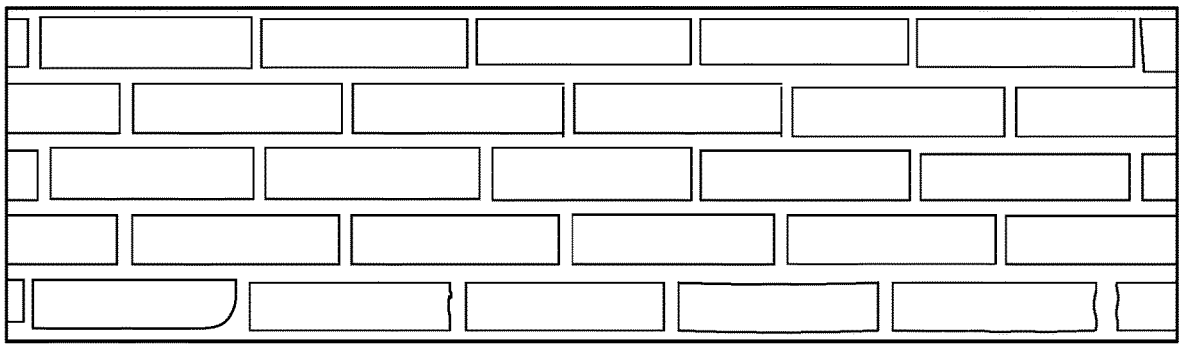
Figure 7F:
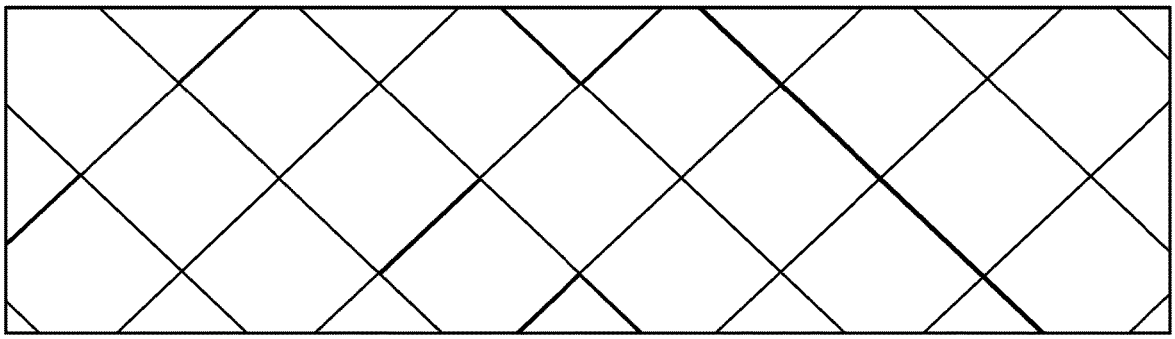
Figure 7G:
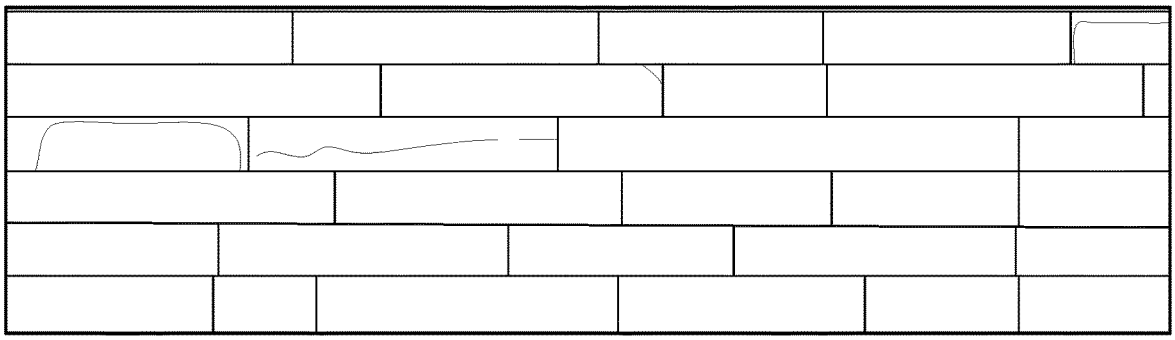
Figure 7H:
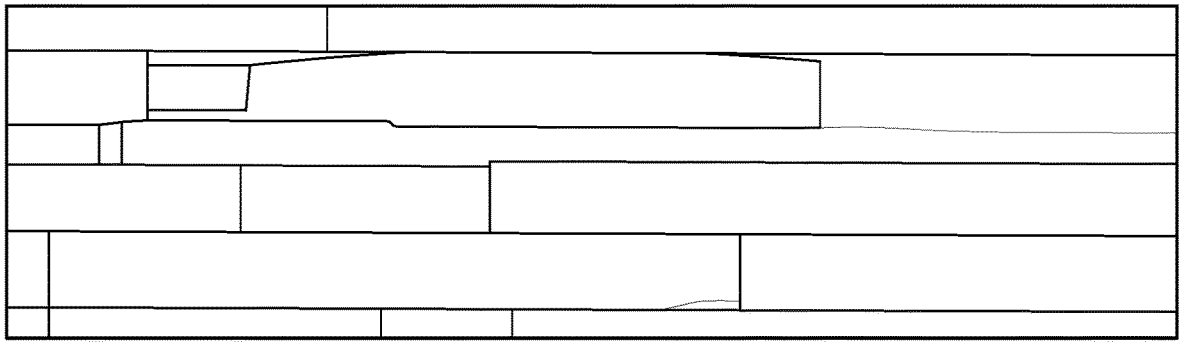

FIGS. 6A and 6B illustrate embodiments of a fireplace 200 in accordance with embodiments, that include a printed image on the surface of the rear wall 207 (i.e., the surface facing the access opening 215. In the embodiments illustrated in FIGS. 6A and 6B, the image is of a landscape. In embodiments, the image on the rear wall 207 is multicolored, and non-homogeneous (i.e., the image is not a single solid color). As shown, the image is visible through the access opening 215 and is visible behind the flame provided in the combustion region. In embodiments, the rear wall 207 and image are heat resistant to prevent degradation by the flame. The rear wall 207 can, for example, include a glass panel, and the image can be painted or printed on the glass panel using ceramic ink. Other embodiments of the fireplace 200 can include other image-bearing rear walls 207. As non-limiting examples of such image-bearing rear walls 207, FIG. 7A shows an abstract image, FIG. 7B shows a cityscape image, FIG. 7C shows the landscape image in FIGS. 6A and 6B in greater detail, FIG. 7D shows a team logo image, FIG. 7E shows a brick wall image, FIG. 7F shows a tile wall image, FIG. 7G shows a stone wall image, and FIG. 7H shows a wood panel image.

Figure 8:
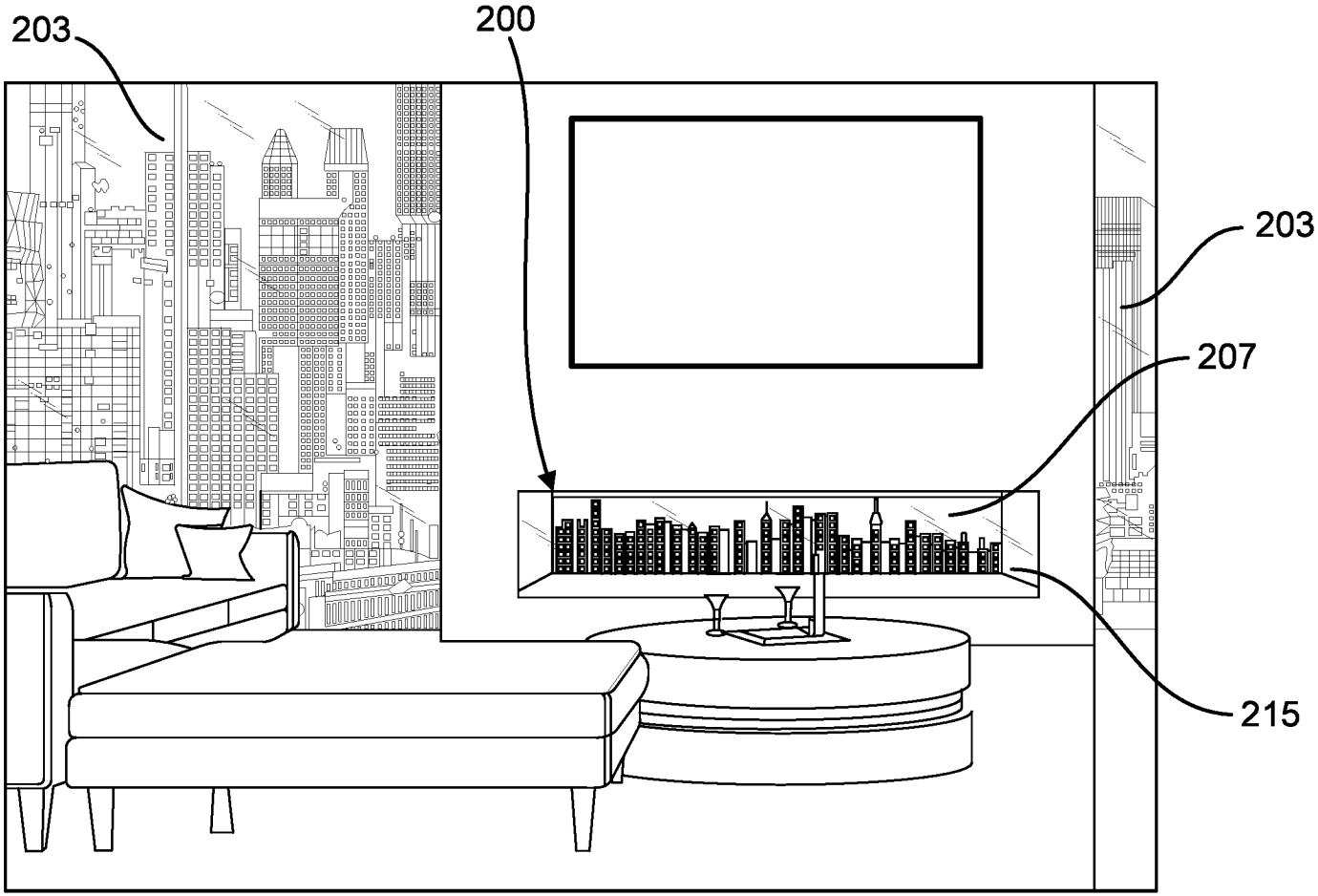
FIG. 8 is an illustration of a fireplace with an image-bearing rear wall in a wall of a building in accordance with embodiments.

The images on the image-bearing rear wall 207 of the fireplace can be selected to match visual aspects of regions surrounding the fireplace 200. For example, the wood in the wood panel image shown in FIG. 7H matches the wood surround 201 around the exterior of fireplace 200 shown in FIGS. 6A and 6B. The cityscape image of the rear wall 207 of the fireplace 200 shown in FIG. 8 matches the cityscape visible through the windows 203 in the wall on the opposite sides of the fireplace.

Figure 9:
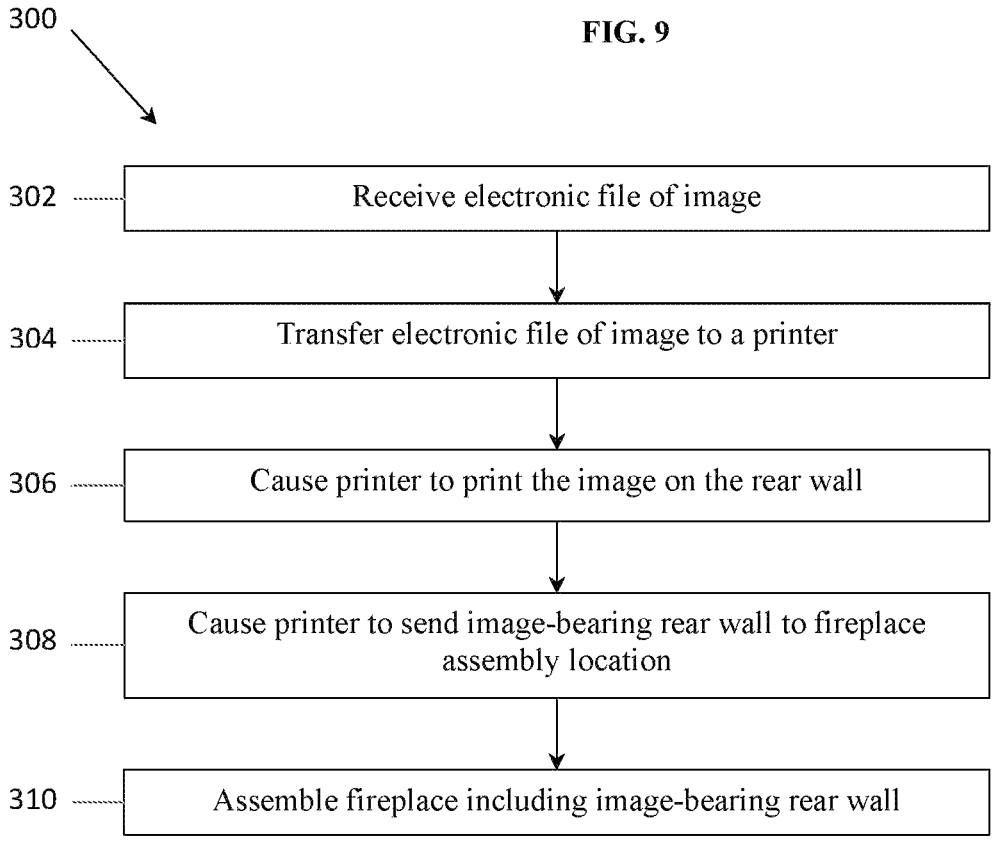
FIG. 9 is a flowchart of an embodiment for manufacturing fireplaces with an image-bearing rear wall.

FIG. 9 is a flowchart describing a method 300 for manufacturing a fireplace such as 200 in accordance with embodiments. As shown at step 302, an electronic file for the image to be printed or otherwise applied on the rear wall 207 can be received over a network. In embodiments, the electronic image file can be received by the fireplace manufacturer over the Internet. The electronic file can be of any image desired by a customer, thereby allowing a high degree of customization by the customer. The electronic image file can be transferred to a printer, for example over a network such as the Internet as shown by step 302. In other embodiments the image file is transferred to the printer over a local network. Other information about the image-bearing rear wall 207, such as the size of the wall and image to be printed, can also be transferred with the image file. In embodiments, the printer is an entity that is capable of printing images in ceramic ink onto glass plates. Using the received image file, the printer prints the image on the rear wall 207 as shown at step 306. The printer then sends or transfers the printed image-bearing wall 207 to the location at which the fireplace 200 is assembled as shown by step 308. In embodiments, a common carrier is used to transport the image-bearing rear wall 207 to the fireplace 200 assembly location. At the assembly location the image-bearing rear wall 207 is assembled with other components to manufacture the fireplace 200 as shown at step 310. Other methods for manufacturing the image-bearing rear wall 207 and assembling that rear wall into the fireplace 200 are used in other embodiments.

Fireplaces such as 200 with image-bearing rear walls 200 can transform a fireplace interior into a unique piece of art with high-definition images of virtually anything that an end-user customer, architect or designer may desire. The fireplaces 200 can be designed to customers' specifications in any size and shape. High-temperature-resistant paint or ink can be incorporated to match any desired design element. Any of a wide range of high definition images can be used, such as for example a beach setting from a stock or original photo used to accent a driftwood log set in the combustion region and natural stone. Exterior (e.g., surround) finishing materials such as brick, stone and tile can be matched with a seamless transition to the interior firebox lining with a relatively efficient installation.

Figure 10:
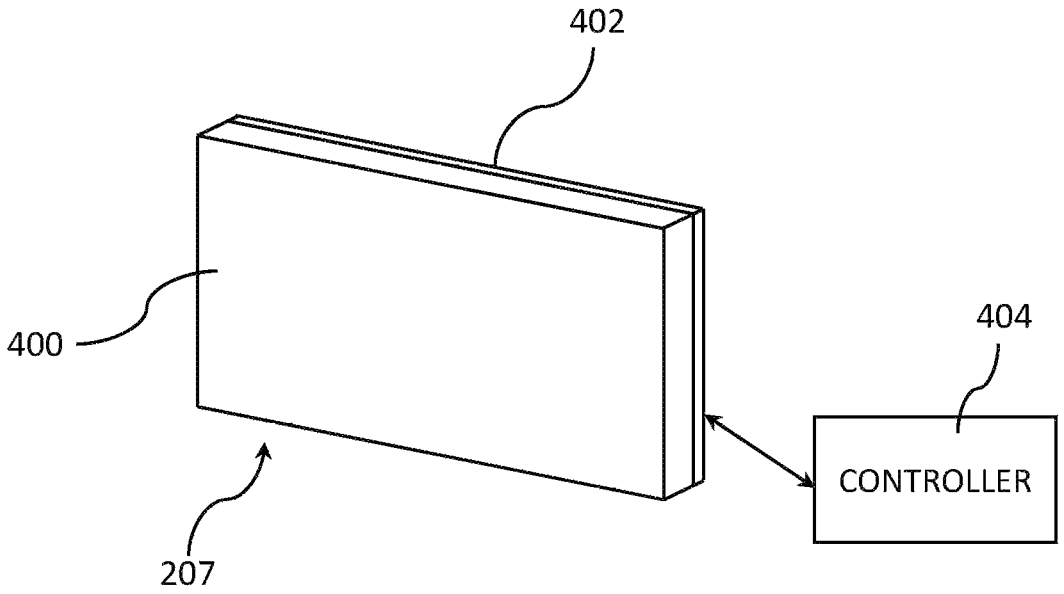
FIG. 10 is a diagrammatic illustration of a controllable/image-bearing rear wall for fireplaces in accordance with embodiments.

FIG. 10 is a diagrammatic illustration of an image-controllable rear wall 207 in accordance with embodiments. As shown, wall 207 includes a transparent glass panel 400 and a switchable film 402 on the panel. A controller 404 is coupled to the switchable film 402. Switchable films and associated controllers such as 402 and 404 are generally known and commercially available. In embodiments, controller 404 can be used to cause the film 402 to switch between a transparent (e.g., first or off) state that will allow light and images to be viewed through the film, and an opaque (e.g., second or on) state (e.g., including frosted or translucent) that substantially blocks light transmission or at least prevents viewing of images through the film.

Figure 11A:
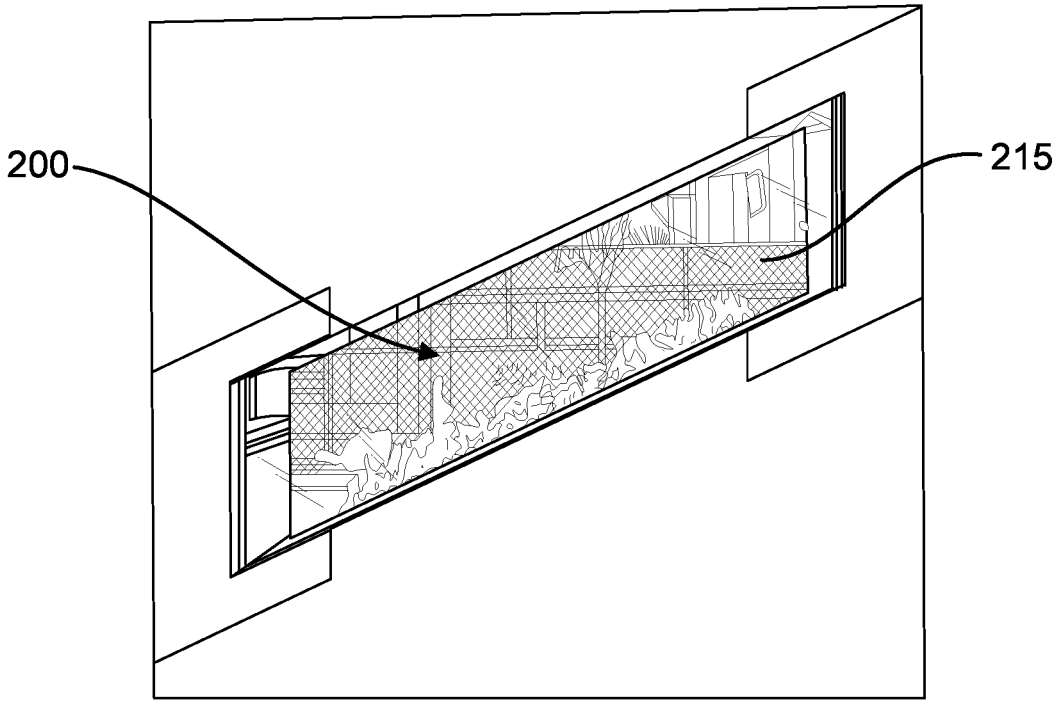
FIGS. 11A and 11B are illustrations of a fireplace including a rear wall in accordance with FIG. 10, from the front side of the fireplace.
Figure 11B:
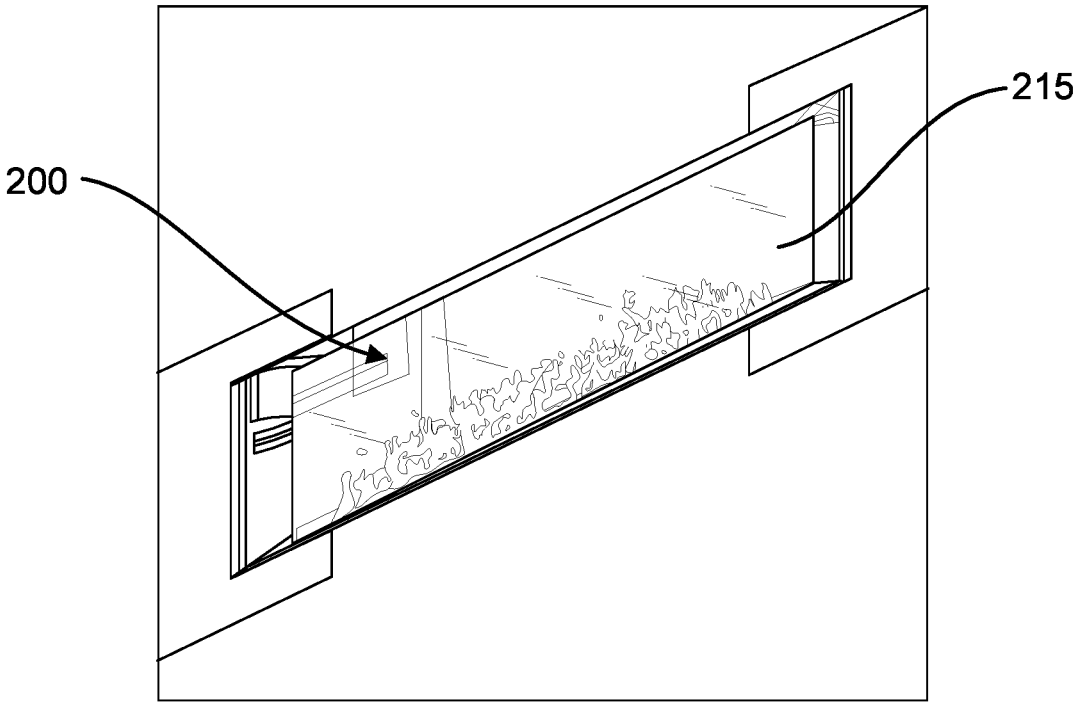
Figure 12A:
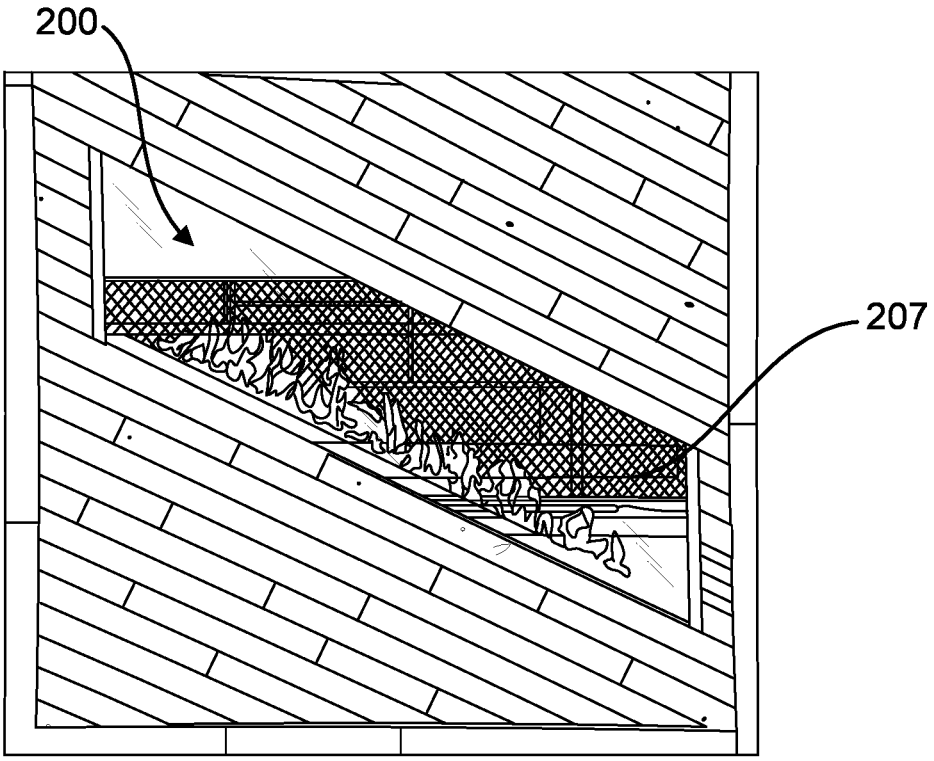
FIGS. 12A and 12B are illustrations of a fireplace including a rear wall in accordance with FIG. 10, from the rear side of the fireplace.
Figure 12B:
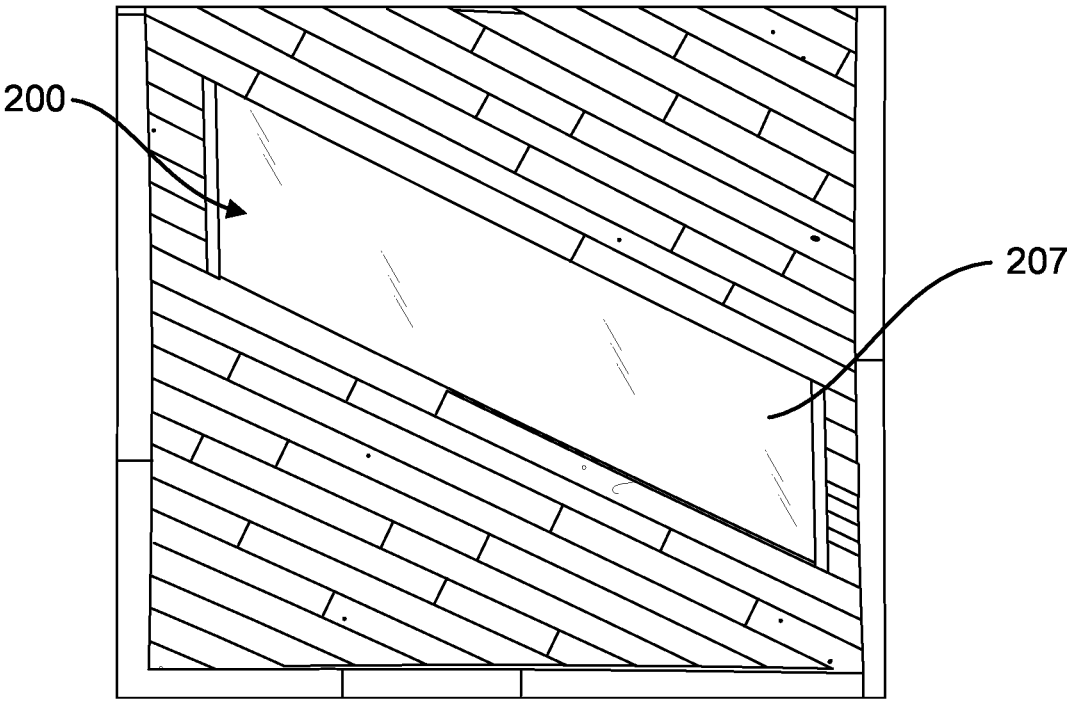

FIGS. 11A, 11B, 12A and 12B illustrate embodiments of a fireplace 200 including embodiments of an image-controllable rear wall 207 such as those described in connection with FIG. 10. FIGS. 11A and 11B illustrate the fireplace 200 from the front side, showing the combustion region and interior of the combustion chamber 254 through the access opening 215. FIG. 11A shows the fireplace 200 with the rear wall 207 in the off or transparent state, with the area behind the fireplace visible through the rear wall (and therefore from the front side through the access opening 215 and combustion chamber 254). FIG. 11B shows the fireplace 200 with the rear wall 207 in the on or opaque state, substantially blocking visibility of the area behind the fireplace from the front side of the fireplace. FIGS. 12A and 12B illustrate the fireplace 200 from the rear or back side (i.e., the side directly facing the rear wall 200, and opposite the side shown in FIGS. 11A and 11B). FIG. 12A shows the fireplace 200 with the rear wall 207 in the off or transparent state as in FIG. 11A, with the interior of the fireplace, including the combustion chamber 254 and flame being visible from the back side. FIG. 12B shows the fireplace 200 with the rear wall 207 in the on or opaque state as in FIG. 11B, with visibility into the interior and combustion chamber 254 of the fireplace substantially blocked. In yet other embodiments of the rear wall described in connection with FIG. 10, the rear wall is configured to controllably display non-homogeneous black and white and color images that are visible to a user through the access opening 215. Images of these types can be provided by imaging structures on the rear wall 207 in response to electronic files representing the images.

Embodiments of fireplaces 200 such as those described with reference to FIGS. 10, 11A, 11B, 12A and 12B have a see-through chassis. They enable alteration of the fireplace configuration to enhance both the function and privacy by efficient control operation. Fireplaces 200 of these types can have any desired size and shape. Applications include bedroom/bathroom and indoor/outdoor see-through fireplaces. Varying levels of privacy and solitude can be achieved by "softening" the view from one side to another, or one room to another. They can be used as creative design elements to alter viewing area and shape. For example, a company logo, team logo, or business name can be presented for view on command.

Although the invention has been described in connection with embodiments, those of skill in the art will recognize that changes can be made in form and detail without departing from the spirit and scope of the invention. For example, rear walls of the types described herein can be used in fireplaces with other structural configurations.

What is claimed is:

1. A method for manufacturing a fireplace of the type including a firebox comprising a combustion chamber, a front opening allowing viewing within the combustion chamber, a back wall opposite the front opening and a combustion region between the front opening and the back wall adapted to provide a flame, the method comprising:

receiving an electronic file for a non-homogenous and multi-color image;

transferring the electronic file to a printer, and causing the printer to print the image on the back wall;

receiving the back wall including the printed image, wherein the printed image includes a non-homogeneous, heat-resistant and multi-color ink image; and assembling the back wall including the printed image into the firebox of the fireplace.

2. The method of claim 1 wherein transferring the electronic file to the printer includes causing the printer to print the image in ceramic ink on the back wall, and wherein receiving the back wall includes receiving the back wall including the printed image including the ceramic ink.

3. The method of claim 2 wherein transferring the electronic file to the printer includes causing the printer to print the image on a glass back wall, and wherein receiving the back wall includes receiving the glass back wall including the printed image.

4. The method of claim 3 wherein receiving the electronic file includes receiving the electronic file for an image including one of a cityscape, a landscape, a brick wall, a wood wall, a tile wall, or a team logo, and wherein receiving the back wall includes receiving the back wall including the printed image including the one of the cityscape, the landscape, the brick wall, the wood wall, the tile wall, or the team logo.

5. The method of claim 1 wherein receiving the image file includes receiving the image file over the Internet.

6. The method of claim 5 wherein transferring the electronic file to the printer includes transferring the image file over the Internet.

7. The method of claim 1 wherein assembling the back wall into the firebox of the fireplace includes positioning the back wall in the firebox opposite the front opening from the combustion chamber.

8. A method for manufacturing a fireplace of the type including a firebox comprising a combustion chamber, a front opening allowing viewing within the combustion chamber, a back wall opposite the front opening and a combustion region between the front opening and the back wall adapted to provide a flame, the method comprising:

receiving an electronic file for a non-homogenous and multi-color image;

transferring the electronic file to a printer, and causing the printer to print the image on the back wall;

receiving the back wall including the printed image, wherein the printed image includes a non-homogeneous, heat-resistant and multi-color ink image printed in ceramic ink; and assembling the back wall including the printed image into the firebox of the fireplace.

9. The method of claim 8 wherein transferring the electronic file to the printer includes causing the printer to print the image on a glass back wall, and wherein receiving the back wall includes receiving the glass back wall including the printed image.

10. The method of claim 8 wherein receiving the electronic file includes receiving the electronic file for an image including one of a cityscape, a landscape, a brick wall, a wood wall, a tile wall, or a team logo, and wherein receiving the back wall includes receiving the back wall including the printed image including the one of the cityscape, the landscape, the brick wall, the wood wall, the tile wall, or the team logo.

11. The method of claim 8 wherein receiving the image file includes receiving the image file over the Internet.

12. The method of claim 11 wherein transferring the electronic file to the printer includes transferring the image file over the Internet.

13. The method of claim 12 wherein assembling the back wall into the fireplace includes positioning the back wall in the firebox opposite the front opening from the combustion chamber.

14. The method of claim 8 wherein assembling the back wall into the fireplace includes positioning the back wall in the firebox opposite the front opening from the combustion chamber.

15. The method of claim 14 wherein transferring the electronic file to the printer includes causing the printer to print the image on a glass back wall, and wherein receiving the back wall includes receiving the glass back wall including the printed image.

* * * * *